US006892426B2

(12) United States Patent
Schmidt et al.

(10) Patent No.: US 6,892,426 B2
(45) Date of Patent: May 17, 2005

(54) ELECTRONIC DEVICE UTILIZING A CLIP AND METHOD FOR PROVIDING THE SAME

(75) Inventors: Peter O. Schmidt, Campbell, CA (US); Jeffrey S. Jones, Los Altos, CA (US); Ron Van Thiel, Menlo Park, CA (US); John Magnasco, San Jose, CA (US)

(73) Assignee: Hello Direct, Inc., San Jose, CA (US)

( * ) Notice: Subject to any disclaimer, the term of this patent is extended or adjusted under 35 U.S.C. 154(b) by 159 days.

(21) Appl. No.: 09/801,398

(22) Filed: Mar. 7, 2001

(65) Prior Publication Data

US 2002/0124355 A1 Sep. 12, 2002

(51) Int. Cl.[7] ..... A44B 21/00

(52) U.S. Cl. ..... 24/3.11; 24/507; 24/508

(58) Field of Search ..... 24/3.11, 3.12, 24/207, 521, 564, 508; 224/269, 617, 666–670; 269/280, 281; 81/422, 423

(56) References Cited

U.S. PATENT DOCUMENTS

| | | | | | |
|---|---|---|---|---|---|
| 4,045,108 | A | | 8/1977 | Olsen | 339/75 P |
| D269,088 | S | | 5/1983 | Genaro et al. | D14/52 |
| 4,580,347 | A | * | 4/1986 | McKnight | 224/669 |
| 4,754,528 | A | * | 7/1988 | Lyons et al. | 224/669 |
| 4,780,934 | A | * | 11/1988 | Vickers et al. | 224/670 |
| D327,886 | S | | 7/1992 | Yan | D14/138 |
| D337,328 | S | | 7/1993 | Beaumont et al. | D14/142 |
| 5,235,728 | A | * | 8/1993 | Nordberg | 224/667 |
| 5,253,292 | A | * | 10/1993 | Fluder et al. | 379/426 |
| D342,249 | S | | 12/1993 | Beaumont et al. | D14/142 |
| D342,250 | S | | 12/1993 | Beaumont et al. | D14/142 |
| 5,465,421 | A | | 11/1995 | McCormick et al. | 455/344 |
| D365,808 | S | | 1/1996 | Alden et al. | D14/107 |
| 5,504,812 | A | | 4/1996 | Vangarde | 379/430 |
| D370,011 | S | | 5/1996 | Lindeman | D14/137 |
| D374,673 | S | | 10/1996 | Beaumont et al. | D14/240 |
| 5,632,069 | A | * | 5/1997 | Mievis | 24/333 |
| D386,104 | S | | 11/1997 | Nowak | D10/104 |
| D391,953 | S | | 3/1998 | Copeland et al. | D14/137 |
| D391,967 | S | | 3/1998 | Blais et al. | D14/240 |
| D392,644 | S | | 3/1998 | McGugan | D14/240 |
| D402,805 | S | | 12/1998 | Nagano et al. | D3/218 |
| 5,890,634 | A | * | 4/1999 | Zuckerman et al. | 223/85 |
| D409,374 | S | | 5/1999 | Laba et al. | D3/215 |
| D413,893 | S | | 9/1999 | Luzbetak et al. | D14/240 |
| D422,999 | S | | 4/2000 | Overton et al. | D14/137 |
| D425,071 | S | | 5/2000 | Boswell | D14/240 |
| D426,529 | S | | 6/2000 | Lohrding et al. | D14/137 |
| 6,071,142 | A | | 6/2000 | Blackman | 439/373 |
| 6,091,832 | A | | 7/2000 | Shurman et al. | 381/381 |
| 6,095,846 | A | | 8/2000 | Becerra | 439/371 |
| D433,005 | S | | 10/2000 | McGugan | D14/155 |
| 6,161,259 | A | * | 12/2000 | Rabenecker | 24/3.1 |
| 6,205,222 | B1 | * | 3/2001 | Carpenter | 379/446 |

FOREIGN PATENT DOCUMENTS

| | | | | |
|---|---|---|---|---|
| GB | 2339834 A | * | 2/2000 | A44B/21/00 |
| JP | 11-40952 | * | 2/1999 | |

* cited by examiner

*Primary Examiner*—James R. Brittain
(74) *Attorney, Agent, or Firm*—Haverstock & Owens LLP

(57) ABSTRACT

An electronic device having a first surface positioned adjacent to an article worn by a person and a second surface substantially perpendicular to the first surface, the electronic device having a headphone connector interface for accepting a headphone connector, the electronic device comprising a clip coupled with the electronic device, the clip having a first segment positioned adjacent to the first surface and a second segment configured at a predetermined angle with respect to the first segment, wherein pressing the second segment toward the second surface rotates the first segment away from the first surface; the clip further comprising an adapter coupled with the first segment of the clip, the adapter positioned between the first segment of the clip and the first surface of the object and having an adapter length.

16 Claims, 4 Drawing Sheets

ELECTRONIC DEVICE UTILIZING A CLIP AND METHOD FOR PROVIDING THE SAME

BACKGROUND OF THE INVENTION

The present invention relates to an apparatus and method thereof of securing an object to a person, in general, and in particular, to an electronic device having a novel clip and headphone support element and method for providing the same.

Many portable wireless transceivers are presently used in the telephone industry. Of these transceivers, many are small enough to utilize a clip or similar apparatus that allows the user to attach the electronic device to the user's belt or other article of clothing. The clips typically found on portable electronic devices pivot about a coil or leaf spring on the back side of the electronic device. Here have been complaints by consumers concerning difficulty in attaching and detaching the electronic device to and from the person's article of clothing or belt. Specifically, the user must reach between the electronic device and their own body to actuate the portion of the clip that allows the clip to pivot.

In addition, almost every electronic device that utilizes a headphone set or earphone has a headphone jack which connects the headphone to the transceiver. One common problem associated with headphone jacks is that the headphone plug, when connected into the headphone jack, often moves or rotates during use. This often causes the headphone plug to become loose, which in turn deteriorates the connection between the jack and the plug.

SUMMARY OF THE INVENTION

What is needed is a clip for securing an object to an article worn by a person, the object, such as an electronic device, has a first surface and a second surface. The first surface is adapted to be worn adjacent to the person and the second surface is positioned substantially perpendicular to the first surface. The clip comprises a first segment and a second segment, whereby the first segment is positioned substantially adjacent to the first surface and the second segment is positioned substantially adjacent to the second surface.

The clip is rotatably coupled with the object such that pressing the second segment toward the second surface rotates the first segment away from the first surface. The first segment of the clip has an end proximal to the second segment and an end distal to the second segment. The first segment further includes a protrusion on the distal end The protrusion faces toward the first surface and has a predetermined length such that the protrusion catches the article between the clip and the object.

In addition, an adapter may be coupled with the first segment of the clip, whereby the adapter is positioned between the first segment of the clip and the first surface of the object. The adapter has an adapter length greater than the predetermined length of the notch and is formed of a frictional material.

The electronic device also has a headphone support element coupled with A headphone connector interface for accepting a headphone connector. The headphone support element has a first receptacle which engages and secures the headphone connector, such that the headphone connector does not rotate or move when coupled with the interface.

The headphone support element includes a first side and a second side, wherein the first side and second side extends substantially perpendicular to the first receptacle. The headphone support element further includes a second receptacle which engages and secures a headphone connector wire. The second receptacle has a third side and a fourth side, wherein each side extends substantially perpendicular to the second receptacle.

Other features and advantages of the present invention will become apparent after reviewing the detailed description of the preferred embodiments set forth below.

DETAILED DESCRIPTION OF THE PREFERRED EMBODIMENT

Figure 1A:
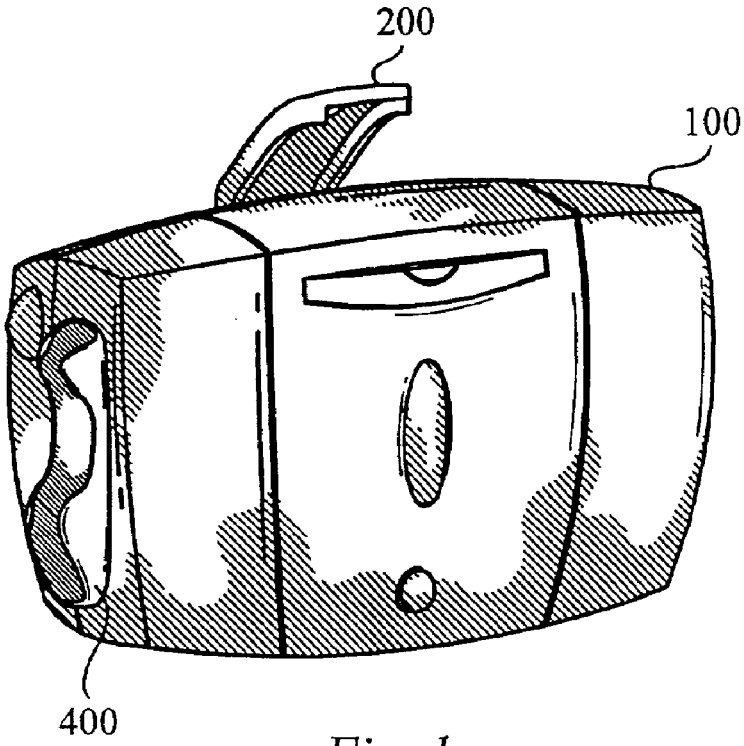
FIG. 1*a* illustrates a perspective view of the electronic device having a modified clip and a headphone plug support element in accordance with the present invention.
Figure 3A:
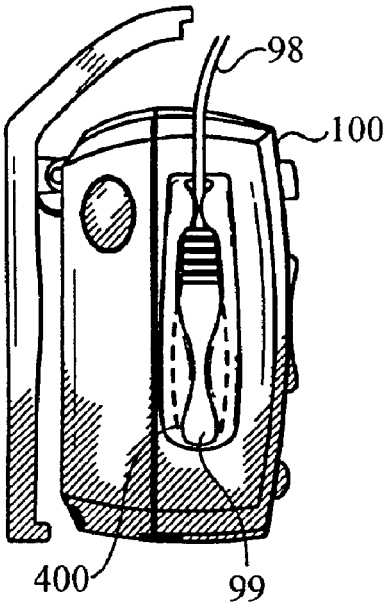
FIG. 3*a* illustrates a side view of the electronic device having a headphone plug connector connected and secured by a headphone plug support element in accordance with the present invention.

FIG. 1 illustrates the preferred embodiment of an electronic device 100, preferably a transceiver, having a clip apparatus 200 and a headphone plug or connector support element 400 attached thereto. The electronic device 100 is shown here as having a substantially rectangular body, however any other shapes may be contemplated. The clip 200 serves to attach the electronic device 100 to an article of clothing worn by a person, such as a belt or pant. The clip 200 is made of any rigid material, and may be used with any object, and thus is not limited to being used with an electronic device. The headphone plug or connector support element 400 serves to prevent a headphone plug or connector, as shown in FIG. 3*a*, from rotating or moving when connected to the headphone jack or interface located on the electronic device as shown in FIG. 1*a*. The details of each component will now be discussed.

Figure 1B:
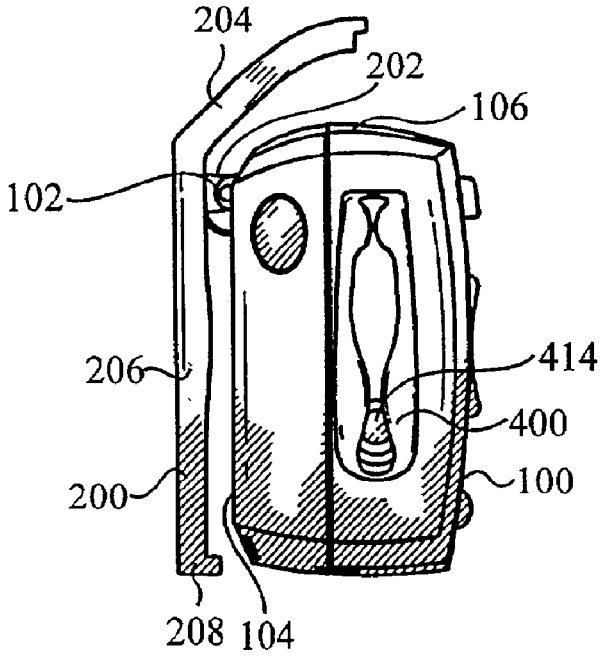
FIG. 1*b* illustrates a side view of the electronic device having a modified clip and a headphone plug support element in accordance with the present invention.

FIG. 1*b* illustrates a side view of the electronic body 100 with the clip 200 and the headphone plug support 400 in accordance with the present invention. Preferably, the clip 200 attaches to the electronic device 100 which has an extension 202 that allows the clip 200 to pivot about the extension 202. The clip 200 is spring urged to a closed position by a coiled or leaf spring (not shown). The clip 200 is formed in two segments or sections, namely a first, lower segment 206 and a second, upper segment 204. The lower segment 206 is substantially parallel to a first, back surface 104 of the electronic device 100 (FIGS. 1*a* and 1*b*) and attaches the electronic device 100 to an article of clothing worn by a person. Specifically, this is done by clasping the article between the lower segment 206 of the clip 200 and the back surface 104 of the electronic device 100.

The second, upper segment 204, as shown in FIG. 1*b*, is rigidly connected to the lower segment 206 and is the part of the clip 200. The upper segment 204 is angled with respect to the lower segment 206 and is located above the pivot point 202. The upper segment 204 is positioned adjacent to a second surface 106 of the electronic device 100, which is substantially perpendicular to the first surface 104. In the preferred embodiment, the upper segment 204 is at an angle greater than 90 degrees to the lower segment 206. However, the upper segment 204 can be at other angles with respect to the lower segment 206. The angled configuration of the upper segment 204 allows the user to directly press down on the upper segment 204 toward the second surface 106, which actuates the clip 200 and causes the lower segment 206 to move or pivot away from the back surface 104. This causes the clip 200 to unclasp and allow the electronic device 100 to be removed from the article. Further, since the clip 200 spring tensioned, releasing the upper segment 204 causes the lower segment 206 to pivot or move toward the back surface 104. This configuration of the clip 200 allows the user to easily attach or detach the electronic device 100 from the belt, because the user does not have to reach behind the electronic device 100 to actuate the clip 200. Thus, the user may use her thumb or palm to actuate the clip 200.

The lower segment 206 of the clip 200 also has a protrusion or notch 208. Specifically, the notch 208 is preferably located at or near the portion of the lower segment 206 that is farthest away from the upper segment 204. In addition, the notch 208 protrudes out a certain distance from the inside surface of the clip's lower segment 206 and faces toward the back surface 104 of the electronic device 100. The notch 208 serves to securely hold the electronic device 100 to the article of clothing by clasping the article between the clip 200 and the electronic device 100.

In addition, the electronic device 100 may be attached to the article of clothing upside down. The notch 208, as discussed above, secures the article between the clip 200 and the electronic device 100. Further, the notch 208 protrudes out far enough from the lower portion 206 of the clip 200 to extend over the top of a belt, thus allowing the electronic device 100 to be positioned upside down onto the belt. Therefore, user can attach or detach the electronic device 100 by pressing the upper segment 204 toward the second surface 106 with her index or middle finger.

Figure 2A:
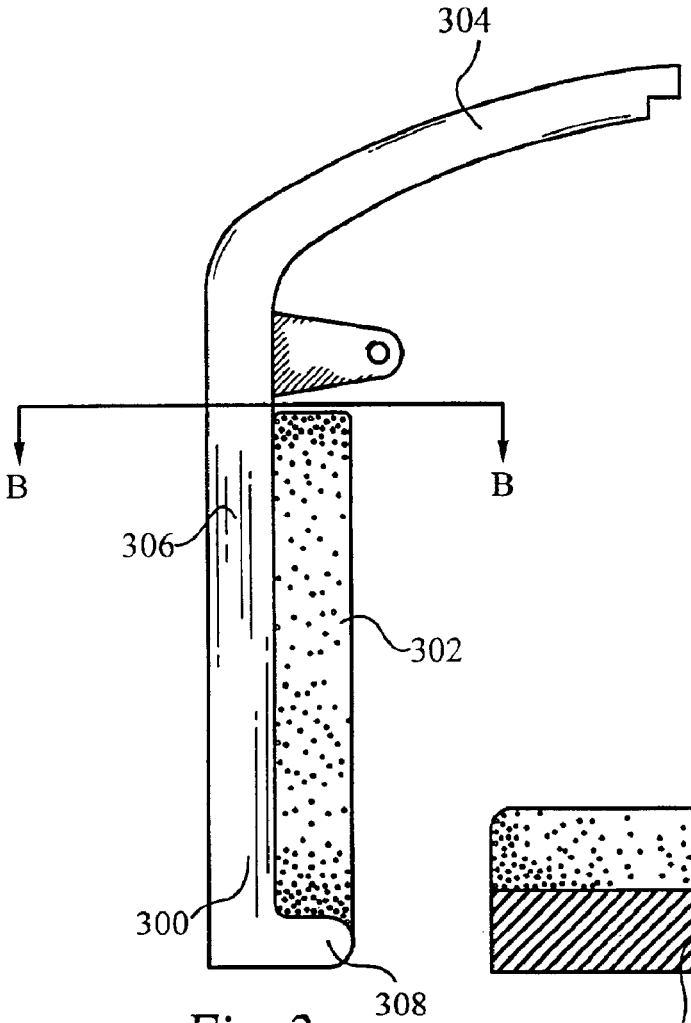
FIG. 2*a* illustrates a side view of a modified clip with a rubber insert in accordance with the present invention.

FIG. 2*a* shows an alternative embodiment of the clip apparatus 300 having an insert adapter element 302 in accordance with the present invention. The structure of the clip 300 shown in FIG. 2*a* is the same as that in FIGS. 1*a* and 1*b*. However, the clip 300 in FIG. 2*a* incorporates an adapter 302 which attaches to the clip 300 and serves to eliminate the notch 308 from the clip 300. The adapter 302 is desirable for users who do not prefer the clip 300 snagging their clothing when the electronic device 100 is attached or detached. It is preferred that the adapter 302 extends out from the inside surface of the clip 300 at a distance greater than that of the notch 208. The adapter 302 extends out past the notch 308 to provide a smooth surface on the inside of the clip 300. The adapter 302 may also have a recess which the notch 208 fits into. The adapter 302 is preferably made of a frictional material which secures the article better than a metal or plastic surface. The adapter 302 can be formed of rubber, foam, neoprene, silicone gel, hard rubber, nylon and the like. The adapter 302 is preferably attached to the clip 300 as shown in FIG. 2*b* to allow the user to remove the adapter 302 if desired.

Figure 2B:
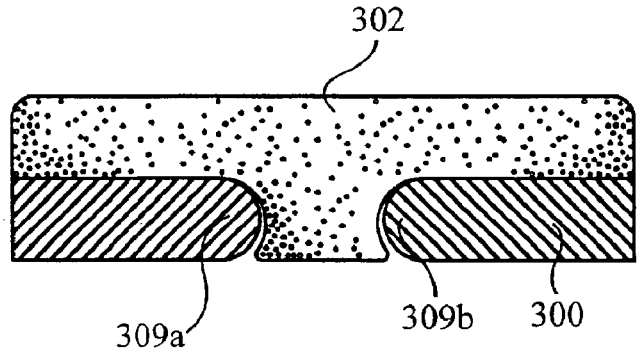
FIG. 2*b* illustrates a cross-segmental view along line b-b of the modified clip with rubber insert in accordance with the present invention.

FIG. 2*b* illustrates a cross-segmental view along line b—b of the clip 300 with the element 302 accordance with the present invention. The clip 300 has a slot defined as the space between the edges 309*a* and 309*b*, in which the adapter 302 frictionally fits within. The slot preferably extends substantially along the length of the lower segment 306 of the clip 300. However, it is not necessary for the slot to run all the way down the lower segment of the clip 306.

Figure 3B:
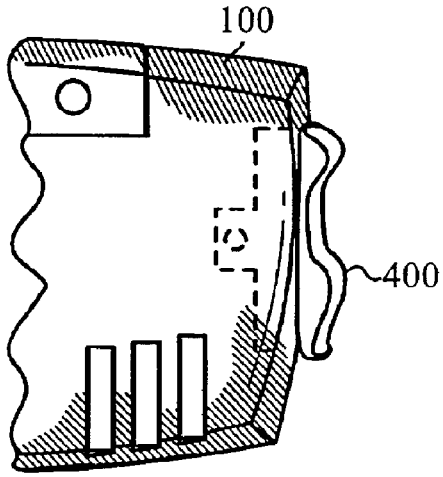
FIG. 3*b* illustrates a back view of the electronic device having the headphone plug support element attached thereto in accordance with the present invention.
Figure 3C:
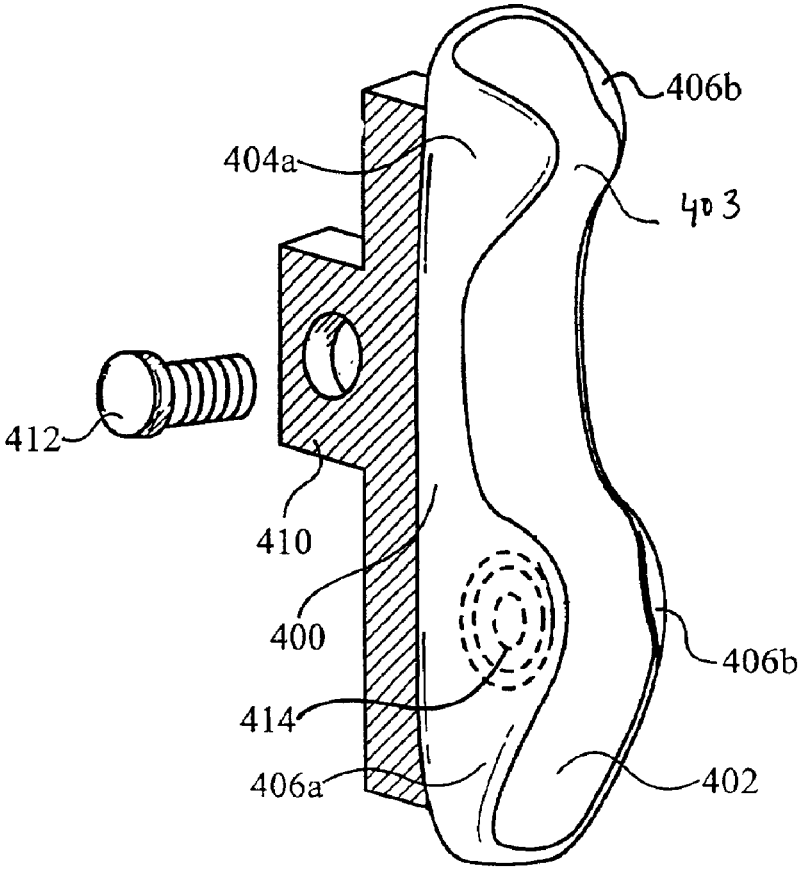
FIG. 3*c* illustrates a perspective view of the headphone plug support element in accordance with the present invention.

FIGS. 3*a*, 3*b* and 3*c* illustrate the electronic device 100 having a headphone plug or connector support element 400 in accordance with the present invention. The headphone support element 400 can have a variety of configurations and shapes, as will be seen. However, the preferred embodiment of the support element 400 is shown in FIGS. 3*a*–3*c*.

As shown in FIG. 3*c*, the support element 400 has a receptacle 402 which houses a headphone jack plug or connector 99 (FIG. 3*a*), an upper segment 404 for securing the wire portion 98 of the headphone connector 99 and a lower segment 406 for securing the larger portion of the headphone connector 99. The upper segment 404 is shown having a receptacle 403, a left side and a right side, both sides contour inward toward each other. Similarly, the lower segment 406 has a receptacle 402, a left side and a right side, each side contours inward toward each other. The upper segment 404 is preferably contoured to have less space between the sides than that of the lower segment 406. This smaller space is to hold the wire 98 within the receptacle 402, because the wire 98 has a smaller width than the lower portion of the headphone connector 99. In contrast, the lower segment 406 preferably is contoured to have more space between the sides to house the lower portion of the headphone connector 99. The receptacle 402 has an opening to allow the headphone connector 99 to connect with the headphone jack or interface 414 of the electronic device 100.

The sides of the lower segment 406 substantially surround the headphone connector 99 in a snug-tight fit, which prevents the connector 99 from rotating or moving when connected to the jack 414. The support element 400 is preferably made of an elastic material, such as rubber or plastic elastomer. However, any other material can be used in the headphone support element 400 so long as the plug 99 does not rotate or move when housed by the support element 400 and connected to the jack 414 and can be easily inserted or removed from the receptacle 402.

In FIGS. 3*b* and 3*c*, the headphone support element 400 is shown inserted into the electronic device 100 by way of a tab 410 and screw 412. However, the support element 400 may be attached to the electronic device by an adhesive, such as glue, by snap fit, or by being integrally manufactured to the body.

Figure 4A:
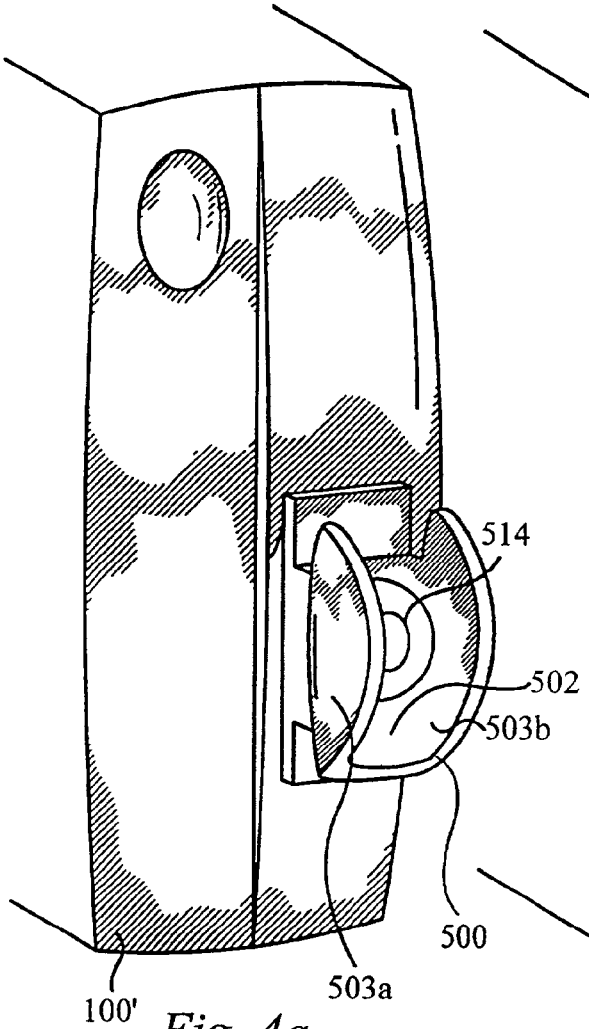
FIG. 4*a* illustrates a perspective view of an alternative embodiment of the headphone plug support element attached to the electronic device in accordance with the present invention.
Figure 4B:
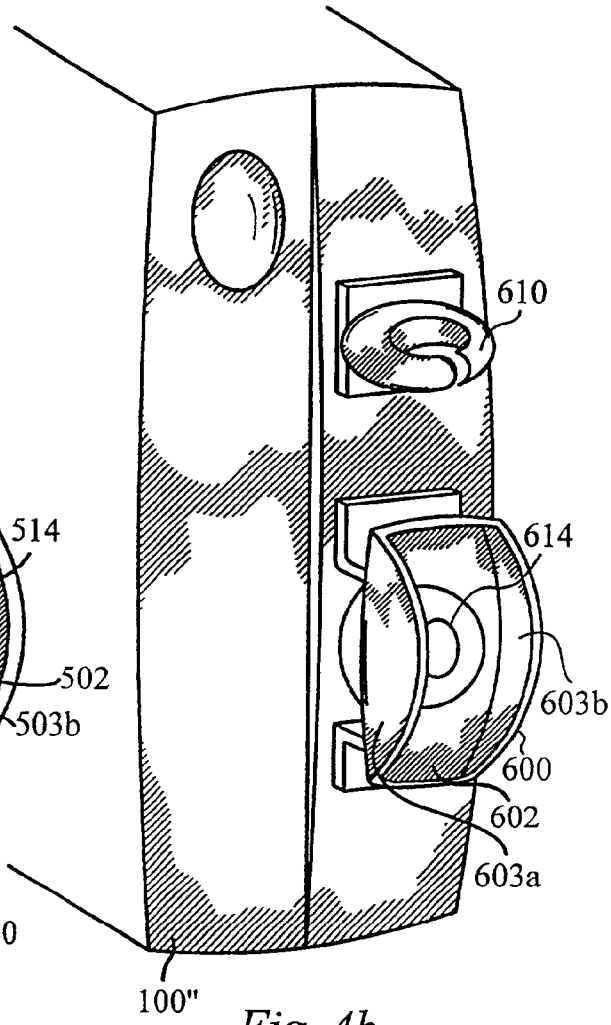
FIG. 4*b* illustrates a perspective view of an alternative embodiment of the headphone plug support element attached to the electronic device in accordance with the present invention.

FIGS. 4*a* and 4*b* illustrate alternative embodiments of the headphone support element 500 and 600 attached to the electronic device 100' in accordance with the present invention. Specifically, FIG. 4*a* shows an support element 500 attached to the electronic device 100'. The support element 500 has a receptacle 502, a left side 503*a* and a right side 503*b*. The left side 503*a* and right side 503*b* prevent the headphone connector 99 from moving when connected to the headphone interface 514. Again, it is preferable that the headphone connector 99 snugly fit within the receptacle 502, such that the connector 99 does not rotate or move when connected to the interface 514. The support element 500 is preferably made of an elastic material, such as rubber or plastic elastomer. However, any other material can be used so long as the connector 99 does not move when housed by the support element 500 and connected to the jack 514 and can be easily inserted or removed from the receptacle 502.

FIG. 4*b* illustrates another alternative embodiment of the headphone support element 600 attached to the electronic device 100" in accordance with the present invention. Specifically, FIG. 4*b* shows a lower support element 600 and an upper support element 610 attached to the electronic device 100". The lower support element 600 has a receptacle 602, a left side 603*a* and a right side 603*b*. The left side 603*a* and right side 603*b* prevent the headphone connector 99 from rotating or moving when connected to the headphone interface or jack 614. Again, it is preferable that the headphone connector 99 snugly fit within the receptacle 602, such that the connector 99 does not rotate or move when connected to the jack 614. In addition, the upper support element 610 is shown to have a ring-like shape which holds the headphone wire 98 within the upper element 610. The support element 600 is preferably made of an elastic material, such as rubber or plastic elastomer.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modification s may be made in the embodiment chosen for illustration without departing from the spirit and scope of the invention.

What is claimed is:

1. A clip for securing an object to an article worn by a person, the object having a first surface and a second surface, wherein the first surface is adapted to be worn adjacent to the person and the second surface positioned substantially perpendicular to the first surface, the clip comprising: a first segment and a second segment, the first segment positioned substantially adjacent to the first surface and the second segment positioned substantially adjacent to the second surface, the clip rotatably coupled with the object such that pressing the second segment toward the second surface rotates the first segment away from the first surface, the clip further comprising a selectively removeable adapter coupled with the first segment of the clip, the selectively removeable adapter positioned between the first segment of the clip and the first surface of the object and providing a flat surface therebetween.

2. The clip according to claim 1 wherein the first segment of the clip has an end proximal to the second segment and an end distal to the second segment, the first segment further comprising a protrusion on the distal end, the protrusion facing toward the first surface and having a predetermined length.

3. The clip according to claim 2 wherein the selectively removeable adapter has an adapter length greater than the predetermined length.

4. The clip according to claim 3 wherein the selectively removeable adapter is formed of a frictional material.

5. A clip for securing an object to an article worn by a person, the object having a surface positioned adjacent to the person, the clip rotatably coupled with the surface and movable about the surface, the clip comprising: a first segment and a second segment and a bend through a predetermined angle between the first and second segments, wherein the first segment is positioned substantially adjacent to the surface and applying a force to the second segment causes the first segment to move away from the surface, the clip having a selectively removeable adapter coupled with the first segment and positioned between the first segment and the surface, thereby providing a uniform surface therebetween.

6. The clip according to claim 5 wherein the first segment of the clip has an end proximal to the second segment and an end distal to the second segment, the first segment including a protrusion on the distal end, the protrusion facing toward the surface and having a predetermined length.

7. The clip according to claim 6 wherein the selectively removeable adapter has an adapter length greater than the predetermined length.

8. A method of attaching an object to an article worn by a person comprising:

a. providing an object having a surface positioned adjacent to the article;

b. coupling a clip with the object about a rotatable axis, the clip having a first segment arid a second segment and a bend through a predetermined angle between the first and second segments, the first segment positioned substantially adjacent to the surface wherein pressing the second segment causes the first segment to move away from the surface; and c. coupling a selectively removeable adapter with the first segment, wherein the selectively removeable adapter is positioned between the first segment and the surface, thereby providing a uniform surface therebetween.

9. An electronic device having a first surface positioned adjacent to an article worn by a person and a second surface substantially perpendicular to the first surface, the electronic device comprising: a clip having a first segment positioned adjacent to the first surface and a second segment configured at a predetermined angle with respect to the first segment, wherein pressing the second segment toward the second surface rotates the first segment away from the first surface, the clip having a selectively removeable adapter coupled with the first segment of the clip and positioned between the first segment and the surface, thereby providing a uniform surface therebetween.

10. The electronic device according to claim 9 wherein the first segment of the clip has an end proximal to the second segment and an end distal to the second segment, the first segment further comprising a protrusion on the distal end, the protrusion facing the first surface and having a predetermined length.

11. The electronic device according to claim 10 wherein the selectively removeable adapter has an adapter length greater than the predetermined length.

12. An adapter for providing a flat surface to a clip, wherein the clip is coupled to an object and having a segment which secures the object to an article worn by a person, the object having a surface adapted to be worn adjacent to the person, the adapter coupled to the segment and positioned between the segment and the surface of the object, wherein the adapter has an adapter length and an extending feature for removably coupling the adapter to the segment, the extending feature substantially centered along a width dimension on an interface surface of the adapter and substantially the adapter length and positioned within an aperture between a first edge and a second edge of the segment.

13. The adapter according to claim 12 wherein the adapter is made of a frictional material.

14. The adapter according to claim 12 wherein the segment of the clip has an end proximal to where the clip is coupled to the object and an end distal to where the clip is coupled to the object, the segment further comprising a protrusion on the distal end, the protrusion facing toward the surface and having a predetermined length such that the protrusion catches the article between the clip and the object.

15. A clip for securing an object to an article worn by a person, wherein the object having a surface positioned adjacent to the article, the clip comprising: a first segment and a second segment and a bend through a predetermined angle between the first and second segments, the clip being rotatably coupled to the object at a position proximal to the second segment, wherein the first segment is positioned substantially adjacent to the surface whereby applying a force to the second segment causes the first segment to move away from the surface, the clip further including a selectively removeable uniform adapter coupled with the first segment and positioned between the first segment and the surface.

16. A clip for securing an object to an article worn by a person, the object having a surface positioned adjacent to the article, the clip comprising: a first segment and a second segment and a bend through a predetermined angle therebetween wherein the article is positioned between the first segment and the surface, the clip being rotatably coupled to the object at a position proximal to the second segment, wherein the first segment is positioned substantially adjacent to the surface whereby applying a force to the second segment causes the first segment to move away from the surface, the clip further including a selectively removeable adapter coupled with the first segment and positioned between the first segment and the surface, thereby providing a substantially uniform surface therebetween.

* * * * *